United States Patent [19]

Heeren

[11] 4,357,146

[45] Nov. 2, 1982

[54] SYNTHETIC FUEL FOR INTERNAL COMBUSTION ENGINE

[76] Inventor: James K. Heeren, 93 Valley View Dr., Wethersfield, Conn. 06109

[21] Appl. No.: 129,583

[22] Filed: Mar. 12, 1980

[51] Int. Cl.[3] ..... C10L 1/18

[52] U.S. Cl. ..... 44/56

[58] Field of Search ..... 44/56; 585/14, 3

[56] References Cited

U.S. PATENT DOCUMENTS

| | | | |
|---|---|---|---|
| 1,412,333 | 4/1922 | Ellis | 44/56 |
| 1,419,910 | 6/1922 | Backhaus | 44/56 |
| 1,420,007 | 6/1922 | Whitaker | 44/53 |
| 1,474,982 | 11/1923 | Schreiber | 44/56 |
| 1,504,837 | 8/1924 | Ricardo | 44/53 |
| 1,527,504 | 2/1925 | Backhaus | 44/56 |
| 1,757,837 | 5/1930 | Johns . | |
| 4,242,100 | 12/1980 | Parker et al. | 44/53 |

*Primary Examiner*—Charles F. Warren
*Assistant Examiner*—Y. Harris Smith

[57] ABSTRACT

A relatively safe and efficient synthetic fuel composition consists of an aromatic hydrocarbon and an alcohol, most notably a mixture of toluene and n-butyl alcohol. It is especially adapted for use as an emergency reserve fuel; however, because the composition may be derived entirely from non-petroleum sources, it also has value as an extender for gasoline.

7 Claims, No Drawings

SYNTHETIC FUEL FOR INTERNAL COMBUSTION ENGINE

BACKGROUND OF THE INVENTION

Because of uncertain petroleum supplies, the general public is unable to rely upon the convenient and ready availability of gasoline, as required and upon demand. Consequently, a need exists for a fuel that can be transported safely in relatively small amounts, to serve as an emergency supply for those occasions on which gasoline cannot be obtained otherwise.

It is, of course, a rather common practice to carry an extra supply of gasoline in the trunk of one's automobile, in anticipation of such a situation. However, because of the risk of fire and/or explosion, especially under hot weather conditions, that practice is at best unwise; indeed, the danger is sufficiently great that the practice is widely prohibited. As a result, there is a substantial need for a substitute fuel that can be transported and stored in small volumes with relatively little risk.

In addition to the primary safety factors, any such fuel must, of course, also produce good mileage and must exhibit good operating characteristics, performing well on start-up, at idle, and under normal running conditions. It must do so, moreover, without need for any adjustment to or modification of the vehicle, and it must be clean-burning, nonpolluting non-corrosive, non-toxic and inoffensive, both in the liquid and also the vapor states. Finally, from the standpoint of practicality, such a fuel must be relatively easy and inexpensive to produce.

While perhaps less dramatic, there is also a demand for a fuel having the foregoing characteristics in connection with recreational vehicles. For example, on outboard motorboats the fuel supply is normally carried in a small tank, which is often subjected to heat and physical abuse.

There have been numerous efforts made in the past to develop synthetic fuels, both to replace gasoline and also to supplement it. The inevitable shortage of petroleum resources has prompted the investigation of practical fuel substitutes derived from alternative sources, such as agricultural wastes (e.g., alcohol) and coal tar (e.g., toluene and benzene). Such substances, as well as additives and extenders for gasoline are, of course, used for specialized applications, such as high performance vehicles and aircraft. However, modifications or substitutions intended to reduce the hazards of fuels seem to have been given little attention.

With more particular reference to the prior art, U.S. Pat. No. 1,338,982 discloses a fuel which consists predominantly of alcohol, and which has combined with it lesser amounts of ether and water. In U.S. Pat. Nos. 1,954,939 and 2,361,054, benzene and/or toluene are added to gasoline, for the purpose of improving the anti-knock value of the product (toluene is, of course, conventionally used as an aviation fuel and as an octane blending stock). U.S. Pat. Nos. 1,131,880 and 1,516,757 suggest the use of various alcohols in combination with kerosene and benzene, with a derivative of kerosene being used in the latter case so as to eliminate the need for benzene, which serves as a blending agent. In U.S. Pat. Nos. 1,398,947 and 1,420,007 airplane fuels are taught which consist of ethyl alcohol and benzene in combination with a low temperature additive, such as an ester or an ether. Finally, Japanese Pat. No. 72/22904 discloses a fuel consisting of kerosene, benzene, toluene and xylene.

Despite all of such earlier efforts, the need remains for a non-petroleum based product which exhibits the combination of properties necessary to provide a satisfactory synthetic emergency fuel, and which is practical from an economic standpoint.

Accordingly, it is a primary object of the present invention to provide a novel synthetic fuel composition which has a relatively low vapor pressure and a relatively high flash point, so as to render it relatively safe for transport and storage in small quantities.

It is also an object of the invention to provide a novel fuel composition derived from a non-petroleum source, which composition may advantageously be used as an emergency fuel supply or as a gasoline extender.

Another object of the invention is to provide such a composition, which performs with substantially the same characteristics as are exhibited by conventional gasoline, and which may be utilized in standard internal combustion engines without need to adjust or modify any of the mechanisms or systems thereof.

Still another object of the invention is to provide a synthetic fuel composition having the foregoing features and advantages, which is also clean-burning and non-polluting, and which, under normal conditions, is neither offensive nor difficult to handle.

Yet another object of the invention is to provide such a fuel composition easily and inexpensively, from common substances which are available in good supply.

SUMMARY OF THE INVENTION

It has now been found that certain of the foregoing and related objects of the invention are readily attained in a synthetic fuel composition consisting essentially of about 20 to 80 percent by volume of an aromatic hydrocarbon and about 80 to 20 percent by volume of an alcohol. The aromatic hydrocarbon is selected from the group consisting of benzene and toluene, and the alcohol is a $C_1$ to $C_5$ compound; mixtures of the aromatic hydrocarbons and of two or more of the alcohols may be used.

In preferred embodiments, the alcohol is selected from the class consisting of isopropyl alcohol, n-butyl alcohol, tert-butyl alcohol and tert-amyl alcohol, with the n-butyl alcohol being considered most desirable. Toluene is the preferred aromatic hydrocarbon and, in either case, the composition will most desirably include at least 50 percent by volume of that ingredient.

Certain objects of the invention are attained in a gasoline-containing fuel mixture. The mixture will comprise about 5 to 95 percent by volume of a synthetic fuel composition, as previously described, admixed with about 95 to 5 percent by volume of gasoline.

DETAILED DESCRIPTION OF THE PREFERRED EMBODIMENTS

Although benzene can be used, alone or in combination with toluene, as the aromatic hydrocarbon component of the compositions of the invention, in general the products utilizing it are less desirable than those produced using toluene by itself. Thus, toluene vapors are less toxic than those of benzene, it is less flammable, slower to evaporate and cleaner burning; consequently, toluene is the preferred aromatic hydrocarbon. Generally, the aromatic hydrocarbon will, in any event, provide about 20 to 80 percent by volume of the composition, and preferably it will comprise at least 50 percent thereof.

Insofar as the alcohol component is concerned, the higher ($C_3$–$C_5$) alcohols are preferred, and may be of either straight or branched chain structure, with n-butyl alcohol providing the most outstanding product in combination with toluene. Nevertheless, methanol and ethanol can advantageously be used, either as the only alcohol or in admixture with the others. However, the lower alcohols are less desirable from the standpoint of work capacity, which translates, in practical terms, to the number of miles per gallon of fuel that they are capable of producing; they are also less desirable from the safety standpoint, i.e., they tend to have higher vapor pressures. When mixtures of lower and higher alcohols are employed, the proportions of the alcohols to one another is not critical, although the higher molecular weight component will normally predominate, again to afford maximum mileage and safety.

It is, of course, true that virtually all of the components herein described may, with a greater or lesser level of satisfaction, be employed alone to fuel internal combustion engines. However, when the alcohols are so used, they tend to exhibit rather poor operating characteristics (especially from the standpoint of starting, idling, and smooth, non-hesitant running and acceleration), particularly when the engine is cold and its settings (e.g., choke) are not adjusted to accommodate the particular alcohol involved.

While the aromatic hydrocarbons, used alone, may perform better than the alcohols, they tend to produce unacceptable levels of exhaust smoke, particularly when the vehicle is operated at low speeds; the same tendency is also very pronounced when kerosene is used. Whereas, however, admixture with the alcohols virtually eliminates the problem with toluene and (to a somewhat lesser extent) benzene, the same is not true of kerosene. Moreover, even when admixed with alcohol or toluene kerosene-based fuels provide difficult ignition in an internal combustion engine, and burn with a characteristic, undesirable odor.

As has been suggested hereinabove, although the primary value of the instant compositions resides in their use as safely transportable emergency fuels, since they can be derived entirely from non-petroleum sources the compositions also offer considerable advantages as extenders for gasoline. This is particularly true because they exhibit performance characteristics that are virtually identical to those of gasoline, and because they can satisfy rigorous anti-pollution standards. The compositions can be admixed with gasoline in virtually any proportions, and without the need for any blending or compatibilizing agents whatsoever.

Exemplary of the efficacy of the present invention is the following Example:

EXAMPLE ONE

A selected alcohol is mixed in an equal volumetric ratio with toluene; the resultant mixture is tested to evaluate its work capacity and its safety characteristics. Work capacity is determined by using the fuel to run a 1975 Courier model Ford automobile; a small tank is mounted on the automobile to permit gravity feed of measured amounts of the fuel. Safety is evaluated using a Parr bomb, to the head of which a pressure gauge is directly attached. The fuel mixture is heated in the bomb, and the pressure developed at 80° Centigrade is taken as an indication of its volatility, and hence of its relative safety.

Presented in Table One below are the results of the foregoing tests using three fuels of the invention, together with data obtained using two different grades of commercial gasoline, which are set forth for purposes of comparison. Work capacity is expressed in miles per gallon (MPG) of fuel, and represents the average of three runs; the 80° Centigrade pressure is expressed in pounds per square inch gauge (PSIG). The table also presents flash point data, which are estimates (in degrees Centigrade) based upon published values for the individual components of the several fuels.

TABLE ONE

| Alcohol Component or Gasoline | MPG | PSIG | °C. |
|---|---|---|---|
| Isopropyl | 30 | 12 | 8 |
| tert-Butyl | 28 | 12 | 8 |
| n-Butyl | 34 | 9 | 17 |
| Gasoline (W) | not tested | 36 | −46 |
| Gasoline (S) | 27 | 29 | −46 |

Both gasolines were Amoco regular grades; "W" represents winter grade nolead, and "S" represents summer grade.

From the foregoing data, it is readily apparent that the fuel mixtures of the invention are not only much less hazardous than the conventional fuels, but they are also (to the extent that a comparison was made) significantly higher in work capacity. As can also be seen, the n-Butyl alcohol/toluene mixture is outstanding in both respects, and hence represents a most preferred embodiment of the invention. Insofar as operating characteristics are concerned, all of the foregoing were virtually indistinguishable from commercial gasoline, providing good performance on start-up and running, and producing a clean exhaust, without requiring any adjustment or alteration whatsoever of the automobile.

The following mixtures (all using toluene as the aromatic hydrocarbon component) perform comparably, in terms of both mileage and also operating characteristics, and they offer similar safety benefits:

TABLE TWO

| Alcohol | Alcohol:Toluene Ratio |
|---|---|
| Isopropyl | 2:1 |
| Isopropyl | 1:4 |
| n-Butyl | 1:2 |
| n-Butyl | 2:1 |
| tert-Amyl | 1:2 |

Blends are made of toluene with methanol (1:1 and 1:4) and ethanol (1:4), and of benzene with ethanol (1:1). While satisfactory in most respects, the overall characteristics of the foregoing are found to be less desirable than those exhibited by the blends described hereinabove in Tables One and Two; moreover, because of the lower BTU values of methanol and ethanol, their mileage performance is also reduced somewhat.

Insofar as vapor pressure is concerned, the compositions of the invention are seen to exhibit very beneficial values, and this is so not only at the 80° Centigrade temperature for which specific pressures are reported, but also at other temperatures to which the fuels would normally be exposed (the 80° values being taken, for the sake of convenience, as representative). Thus, tests at temperatures of from about 70° to about 97° Centigrade show that the same relationship among the vapor pressures of the specified compositions holds true over the entire range. More particularly, the order of increasing vapor pressure (and hence, decreasing safety) for the tested substances defined in Table One is: n-butyl alcohol/toluene, tert-butyl alcohol/toluene, isopropyl alcohol/toluene, summer grade gasoline, and winter grade gasoline. As can also be seen from the foregoing data, there is a correlation between the vapor pressures and the flash points of the several fuels, as would be expected from common (albeit not invariable) experience, thus further illustrating the desirable hazard-related characteristics of the present compositions. The reported flash point values can be confirmed by open-cup ignition tests, in which the various fuels perform substantially as indicated.

For the sake of comparison, a mixture of kerosene, benzene and ethyl alcohol is formulated, in accord with the broad disclosure of U.S. Pat. No. 1,131,880. In light of the absence of any indication in the patent of specific proportions, various amounts of the components are admixed to find an operative blend; notwithstanding considerable difficulty in producing compatible mixtures, it is ultimately found that a 2:1:1 ratio of benzene:kerosene:alcohol produces a clear solution that is stable at ambient temperatures. While performing reasonably well in an internal combustion engine, the mixture burns in an open cup test with a sooty flame, and produces a strong "oil burner" odor in the exhaust gases.

The mixture described in U.S. Pat. No. 1,338,982 (ethyl alcohol—75%, ether—10% and water—15%) is also formulated for comparison with the compositions of the invention. It will fuel an internal combustion engine only with significant departure from normal carburation settings, and so is not satisfactory, within the concepts of the present invention.

In accordance with U.S. Pat. Nos. 1,398,947 and 1,420,007, compositions containing ethyl alcohol (40%), benzene (30%) and either ethyl ether or ethyl acetate (30%) are made. Because of low flash point and considerable ignition knock, the first-mentioned blend is unacceptable; while improved in those respects, but still exhibiting a low flash point characteristic, the second-mentioned blend produces some hesitation upon acceleration.

Finally, among other compounds evaluated for performance, n-butyl alcohol is tested by itself, and is found to be incapable of starting a high compression internal combustion engine. A low-compression engine will start with considerable difficulty and will run, but not well (i.e., combustion is incomplete, odors are excessive, etc.) These facts, taken with the synergistic results that are obtained with the toluene/n-butyl alcohol blend (as shown by the data set forth above), are indicative of the unexpected benefits that are afforded by the instant compositions.

Thus, it can be seen that the present invention provides a novel synthetic fuel composition having a relatively low vapor pressure and a relatively high flash point, rendering it relatively safe and hence suitable for use as an emergency fuel. The composition may be derived entirely from non-petroleum sources, and it exhibits substantially the same performance characteristics as conventional gasoline; consequently, it is adapted for use in standard internal combustion engines without adjustment of or modification to any of the mechanisms or systems thereof, and it may readily serve as a gasoline extender. In addition, the compositions of the invention are clean-burning and non-polluting, and are, under normal conditions, neither offensive nor difficult to handle; they may be produced easily and inexpensively from common substances that are available in good supply.

Having thus described the invention, what is claimed is:

1. A relatively safe automobile fuel composition consisting of an aromatic hydrocarbon selected from the group consisting of benzene and toluene, and at least one $C_1$ and $C_5$ alcohol, said aromatic hydrocarbon and alcohol being present in a volumetric ratio of about 1:4 to 4:1.

2. The composition of claim 1 wherein said alcohol is a $C_3$ to $C_5$ compound.

3. The composition of claim 2 wherein said alcohol is selected from the class consisting of ispropyl alcohol, n-butyl alcohol, tert-butyl alcohol and tert-amyl alcohol.

4. The composition of claim 3 wherein said alcohol is n-butyl alcohol.

5. The composition of claim 1 containing at least 50 percent by volume of said aromatic hydrocarbon.

6. The composition of any of claims 1, 2, 3, 4, or 5 wherein said aromatic hydrocarbon is toluene.

7. The composition of claim 1 consisting essentially of about 50 to 80 percent by volume of toluene and conversely about 80 to 50 percent by volume of an alcohol selected from the class consisting of isopropyl alcohol, n-butyl alcohol, tert-butyl alcohol and tert-amyl alcohol.

* * * * *

UNITED STATES PATENT AND TRADEMARK OFFICE

CERTIFICATE OF CORRECTION

PATENT NO. : 4,357,146

DATED : November 2, 1982

INVENTOR(S) : James K. Heeren

It is certified that error appears in the above—identified patent and that said Letters Patent is hereby corrected as shown below:

Claim 1, line 4 (column 6, line 29), delete "and" (1st. occurrence) and substitute --to-- therefor.

Signed and Sealed this

*Eighth* Day of *February 1983*

[SEAL]

*Attest:*

GERALD J. MOSSINGHOFF

*Attesting Officer*

*Commissioner of Patents and Trademarks*